United States Patent [19]

Ralston

[11] 3,990,469

[45] Nov. 9, 1976

[54] BASEMENT DRAINAGE STRUCTURE

[76] Inventor: Gary D. Ralston, 2327 N. 5th, Clinton, Iowa 52732

[22] Filed: July 9, 1975

[21] Appl. No.: 594,320

[52] U.S. Cl. ..... 137/362; 52/287

[51] Int. Cl.[2] ..... E02D 31/02

[58] Field of Search ..... 52/169, 198, 287; 137/362

[56] References Cited

UNITED STATES PATENTS

| | | | |
|---|---|---|---|
| 1,734,777 | 11/1929 | Pike | 52/198 X |
| 3,304,672 | 2/1967 | Bakke | 52/169 |
| 3,332,185 | 7/1967 | Adams | 52/287 |
| 3,344,569 | 10/1967 | Cotten | 52/287 |
| 3,413,769 | 12/1968 | Hoyt | 52/198 |
| 3,562,982 | 2/1971 | Parezo | 52/169 |
| 3,668,829 | 6/1972 | Nelson | 52/169 |
| 3,850,193 | 11/1974 | Guzzo | 137/362 |

*Primary Examiner*—Robert G. Nilson

*Attorney, Agent, or Firm*—Henderson, Strom & Sturm

[57] ABSTRACT

A plurality of elongated drainage members connected in end to end fashion. The drainage members are located about the periphery of a basement floor, upon the floor and adjacent the basement walls. Each drainage member has a base and a wall connected to the base and spaced apart from the basement wall. A sealant member connects the bases to the basement floor. A drain channel is attached to one drainage member, whereby water collected by the drainage members is directed to an area drain in the basement. A flush assembly is attached to a drainage member half-way about the periphery of the basement floor from the drain channel.

3 Claims, 4 Drawing Figures

BASEMENT DRAINAGE STRUCTURE

BACKGROUND OF THE INVENTION

This invention relates generally to drainage structures and more particularly to drainage structures adapted for use in basements of buildings. Keeping the basements of buildings dry is a recurring problem. Cracks develop in basement walls allowing water to leak into the basement, and water condenses on the surface of the basement walls. As a consequence, water flows over the basement floor.

A number of structures have been developed in response to the aforementioned problem. One device is directed toward confining the leakage of moisture from the junctures between a wall and the floor of a basement. This device includes an elongated member which arcs between the basement wall and the basement floor to enclose the juncture between a wall and the floor. This structure is inadequate because water condensing upon or leaking through the basement walls elsewhere than at the base travels over the arcuate member and onto the basement floor.

Other structures have been developed which use drain tiles located about the periphery of the basement adjacent to the inside of the basement walls. These structures require that the drain tiles be located beneath the basement floor and that a space be provided between the periphery of the basement floor and the basement walls. One structure provides that a plurality of vertical passage-forming members, U-shaped in horizontal section, be placed in the space between the walls and floor for directing water beneath the basement floor to the drain tiles. These structures are inadequate due to the necessity of tearing up large portions of the basement floor in order to install the structures in a home which has already been constructed.

SUMMARY OF THE INVENTION

A drainage structure, for use in the basement of a building to keep the floor of the basement dry, is provided which includes a plurality of elongated drainage members joined in end to end fashion and located about the periphery of the basement floor adjacent the basement walls. Each of the drainage members has a base and an upstanding wall, the base being upon the basement floor with one edge against the basement wall, and the upstanding wall being attached to the opposte edge of the base and away from the basement wall.

A sealant member interconnects the bases with the basement floor and walls. The thickness of the sealant between the bases and the floor varies, with a place of maximum vertical dimension being located half-way about the drainage structure from a place of minimum vertical dimension. A drain channel is attached to the drainage member over the place of minimum thickness of the sealant, and water is caught by the drain structure and carried above the level of the basement floor to the drain channel, where it is directed to the area drain of the basement.

It is an object of this invention to provide a basement drainage structure which can be installed in basements of any configuration for keeping water from flowing across the basement floor.

Another object of this invention is to provide a basement drainage structure which is installed upon the basement floor and which carries water away from the basement walls at a level above the floor, thereby eliminating the costly operation of tearing up and replacing portions of the basement floor when installling a drainage system.

Still another object of this invention is to provide a basement drainage structure which is readily accessible for purposes of repair and which is easily flushed out for purposes of clearing and cleaning.

A further object of this invention is to provide a novel basement drainage structure which is economical of manufacture, durable and capable of fulfilling the aforementioned objects.

These objects and other features and advantages of the basement drainage structure of this invention will become readily apparent upon referring to the following description, when taken in conjunction with the appended drawings.

BRIEF DESCRIPTION OF THE DRAWINGS

The basement drainage structure of this invention is illustrated in the appended drawings, wherein.

DESCRIPTION OF THE PREFERRED EMBODIMENT

Figure 1:
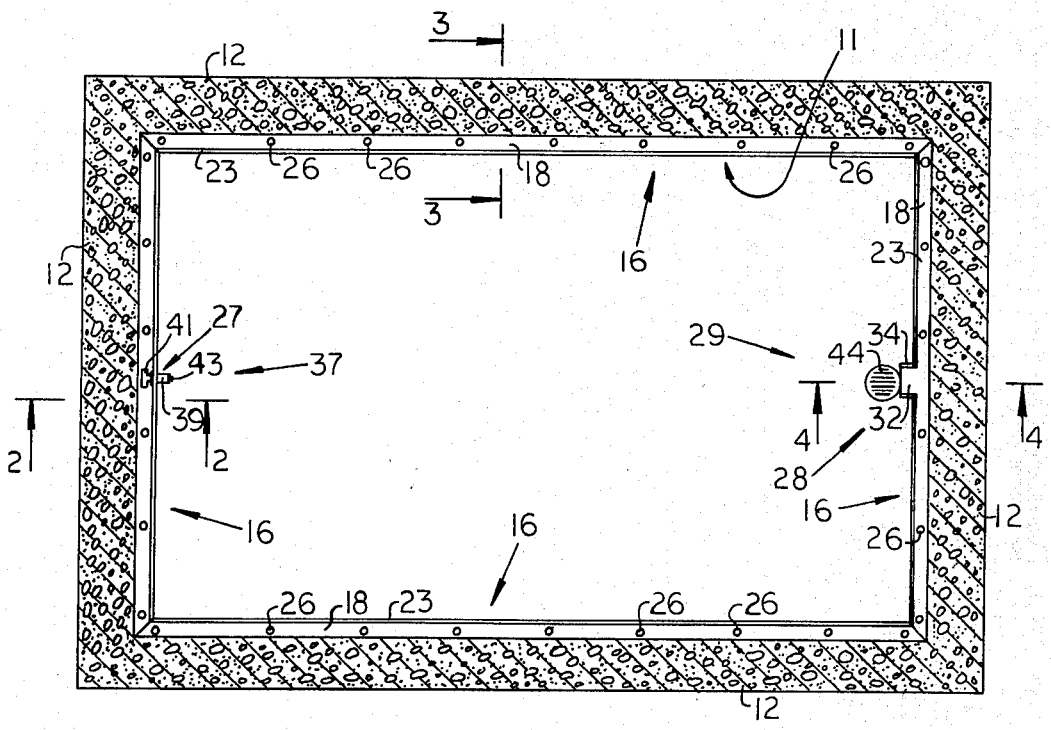
FIG. 1 is a top plan view of the basement drainage structure installed in the basement of a building.

Referring now to the drawings, the drainage structure of this invention is indicated generally at 11 in FIG. 1 installed in the basement of a building. The drainage structure 11 is installed in the basement adjacent the basement walls 12, which walls 12 are supported by footings 13 (FIGS. 2, 3 and 4) in the usual manner. The drainage structure 11 is located upon the basement floor 14 about the periphery thereof. The drainage structure 11 includes more particularly a plurality of elongated drainage members 16 and a sealant member 17.

Figure 3:
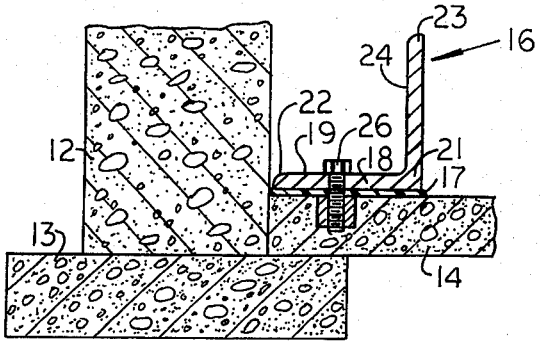
FIG. 3 is a sectional view taken along line 3—3 of FIG. 1.

Referring to FIGS. 1 and 3, each drainage member 16 includes a horizontally disposed base portion 18. The base portion 18 has a flat upper surface 19 and inner and outer longitudinal edges 21, 22. Each drainage member 16 also includes a wall member 23 which is vertically disposed and is joined to the base 18 at the inner edge 21. The wall 23 has an inner side 24 facing the basement wall 12. The drainage members 16 may be constructed of steel or aluminum angle pieces or of fibreglass or plastic molded material. A tar coating or other suitable water-proofing coating, not shown here, may be applied to the inner side 24 of wall member 23 and to the upper surface 19 of base 18.

Figure 2:
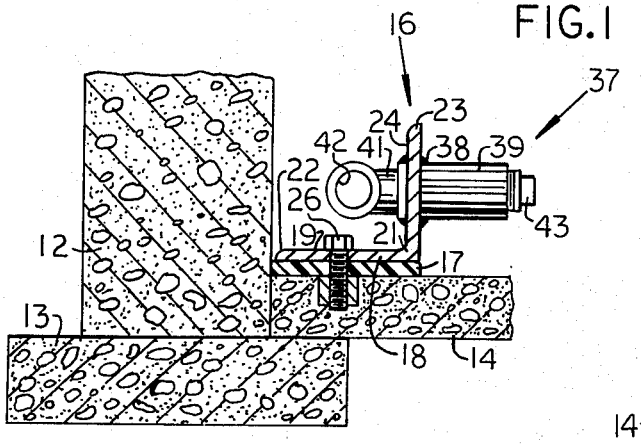
FIG. 2 is a sectional view taken along line 2—2 of FIG. 1 showing the flushing assembly.

The drainage members 16 are attached to the basement floor 14 by bolts 26 and by the sealant member 17 (FIGS. 2 and 3). The bases 18 are flat upon the basement floor 14, the sealant member 17 being between the bottoms of the bases 18 and the basement floor 14. The outer edges 22 are against the basement walls 12, the inner edges 21 being directed toward the interior area of the basement, and the sealant member 17 extends from against the basement walls 12 to directly under the inner edges 21. The walls 23 upstanding from the bases 18 are spaced apart from the basement walls 12 and, together with the walls 12 and bases 18, form a continuous channel which is U-shaped in cross section.

The sealant member 17 is of a rubber material and is glued to the surface of the basement floor 14 and the underside of the bases 18, or is of a rubber cement type of material. The sealant member 17 has a variable thickness or vertical dimension between the bases 18 and the floor 14, having a place of maximum thickness 27 and a place of minimum thickness 28. The vertical dimension of the sealant 17 uniformly decreases from the place of maximum thickness 27 toward the place of minimum thickness 28. The drainage members 16 resting upon the sealant 17 are thereby supported at an angle to the floor 14, the portion of the drainage members 16 above the place of maximum thickness 27 being disposed highest above the level of the floor 14 and the portion of the drainage members 16 above the place of minimum thckness 28 being disposed closest to the floor 14. The drainage members 16 angle downwardly uniformly from their highest elevation above thickness 27 to their lowest elevation above thickness 28.

Figure 4:
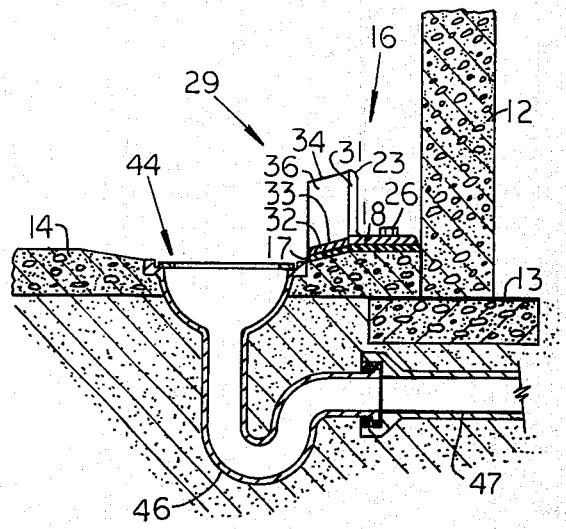
FIG. 4 is a sectional view taken along line 4—4 of FIG. 1 showing the drain channel assembly.

The drainage structure 11 has a drain channel assembly 29, FIGS. 1 and 4, which is connected to the drainage member 16 which is over the place of minimum thickness 28 of the sealant 17. This drainage member 16 has an aperture 31 formed in the wall member 23 thereof directly over the place of minimum thickness 28. A flat member 32 is joined, through the aperture 31, to the base 18 of the drainage member 16 and is perpendicular to member 16. The sealant member 17 extends under the flat member 32 to affix the member 32 to the floor 14. The top surface 33 of the flat member 32 may be coated with tar or other water resistant coating, not shown here. Each of the parallel upstanding sides 34 are joined to one of the longitudinal edges of the flat member 32 and to the wall member 23 on one side of the aperture 31. The inwardly facing walls 36 of the sides 34 may also be coated with a water resistant substance.

The drainage structure 11 has a flushing assembly 37, FIGS 1 and 2, which is connected to the drainage member 16 which is over the place of maximum thickness 27 of the sealant 17. This drainage member 16 has an opening formed at 38 in the wall member 23 thereof. A pipe coupling 39 is affixed through the opening 38, and a pipe tee 41 is threaded into the pipe coupling 39. The pipe tee 41 is disposed between the wall member 23 and basement wall 12, and has apertures 42 directed along the length of the drainage member 16 in both directions and away from the place of maximum thickness 27. A plug 43 is threaded into the pipe coupling 39 at the end opposite to the pipe tee 41. The plug 43 may be removed and a hose (not shown) threaded into the coupling 39.

When the drainage structure 11 is used, drainage members 16 in sufficient numbers and lengths are selected such that the structure 11 will fit the conformation of the basement. The drainage members 16 are placed about the periphery of the basement floor 14 adjacent the basement walls 12, the sealant member 17 first being placed down upon the floor 14, and the bolts 26 lastly being placed through the members 16, 17 into the floor 14. The placement of the area drain structure 44 in the basement floor 14 is asertained such that the place of minimum thickness 28 of the sealant member 17 is located adjacent thereto, and the drainage member 16 having the drain channel assembly 29 is located over the place of minimum thickness 28 to direct the channel assembly 29 toward the drain structure 44. The drainage member 16 having the flushing assembly 37 is located over the place of maximum thickness 27 of the sealant member 17 half-way around the periphery of the basement from the drain channel assembly 29.

Water which leaks through cracks in the basement wall 12 or which condenses on the surface of the wall 12 is caught in the channel formed by the drainage members 16 of the structure 11. The water is carried, at a level above the basement floor 14, flowing downwardly away from the highest portion and toward the lowest portion of the drainage members 16 to the drain channel assembly 29, passing therethrough into the area drain structure 44, through a P-trap structure 46 to the line 47 leading to the sewer, FIG. 4. Should the drainage structure 11 need cleaning, the plug 43 is removed from the coupling 39 and replaced by a hose. Water is forced through the pipe tee 41, being directed through apertures 42 in opposite directions from the tee 41 and toward the drain channel 29. The water carries dirt and clogging materials, at a level above the basement floor 14, as it is directed to the area drain 44.

The drainage structure 11 can be installed in basements of any configuration and keeps water from flowing across the basement floor 14. The structure 11 is easily cleaned and carries the flushing water, as well as water which has leaked through the basement walls 12 or condensed thereupon, at a level above the basement floor 14 to the area drain 44. The basement floor 14 need not be broken up to install the drainage structure 11. Thus it can be seen that the objects of this invention have been attained.

Although a preferred embodiment has been disclosed herein, it is to be remembered that various modifications and alternate constructions can be made thereto without departing from the full scope of the invention as defined in the appended claims.

I claim:

1. A drainage structure for use in the basement of a building, comprising:

a plurality of elongated drainage members connected in end to end fashion and located about the periphery of the basement floor adjacent the basement walls, each of said drainage members having a base member and a wall member, said base member being above and connected to the basement floor and having inner and outer edges, said outer edge being adjacent the basement wall, said wall member being attached at said inner edge of said base and upstanding therefrom in spaced relation to the basement wall; and sealant means interconnecting said outer edge of said base with the basement wall, and interconnecting said base with the basement floor, whereby water condensing on the basement walls or leaking therethrough is caught and carried away from the basement walls at a level above the basement floor, said sealant means having a variable thickness between said base members and the basement floor, sad sealant means having a place of maximum thickness and a place of minimum thickness and having a decreasing thickness from said place of maximum thickness to said place of minimum thickness, said sealant means supporting said drainage members at an angle to the floor, whereby water is made to flow through said drainage members to a point directly over said place of minimum thickness.

2. A drainage structure as defined in claim 1 and further wherein said drainage members include a drain channel means, said drainage member which is over said place of minimum thickness having an aperture formed in said wall member directly over said place of minimum thickness, said aperture being rectangular in configuration and extending from said base member to the top of said wall member, said channel means having parallel upstanding walls and a flat member, said flat member being connected to the basement floor by said sealant means and passing through said aperture to attachment with said base member, said upstanding walls being attached to opposite sides of said flat member and to said wall member on opposite sides of said aperture.

3. A drainage structure as defined in claim 2 and further wherein said drainage members include a flushing means for directing fluids in two, opposite directions, said drainage member which is over said place of maximum thickness having an opening formed in said wall member directly over said place of maximum thickness, said place of maximum thickness being located half-way around the periphery of the basement wall from said place of minimum thickness, said flushing means including a pipe member projecting through said opening and a pipe tee affixed to said pipe member and disposed between said wall member and the basement wall, whereby water may be introduced and directed in opposite directions from said place of maximum, thickness along said drainage members toward said place of minimum thickness to positively clean said drainage members.

* * * * *